US007166397B2

(12) United States Patent
Mishra et al.

(10) Patent No.: US 7,166,397 B2
(45) Date of Patent: Jan. 23, 2007

(54) IMAGING MEMBERS

(75) Inventors: Satchidanand Mishra, Webster, NY (US); Anthony M. Horgan, Pittsford, NY (US); Robert C. U. Yu, Webster, NY (US); Dasarao K. Murti, Mississauga (CA); Suresh K. Ahuja, Webster, NY (US)

(73) Assignee: Xerox Corporation, Stamford, CT (US)

( * ) Notice: Subject to any disclaimer, the term of this patent is extended or adjusted under 35 U.S.C. 154(b) by 84 days.

(21) Appl. No.: 10/744,369

(22) Filed: Dec. 23, 2003

(65) Prior Publication Data

US 2005/0136349 A1 Jun. 23, 2005

(51) Int. Cl.
*G03G 5/047* (2006.01)

(52) U.S. Cl. ..... 430/58.8; 430/58.05; 430/133; 430/970

(58) Field of Classification Search ..... 430/58.05, 430/58.65, 58.35, 58.3, 58.4, 58.75, 58.8, 430/59.6, 970, 133
See application file for complete search history.

(56) References Cited

U.S. PATENT DOCUMENTS

| | | | | |
|---|---|---|---|---|
| 3,121,006 | A | 2/1964 | Middleton et al. | |
| 4,233,384 | A | 11/1980 | Turner et al. | |
| 4,265,990 | A | 5/1981 | Stolka et al. | |
| 4,273,846 | A * | 6/1981 | Pai et al. | 430/58.75 |
| 4,286,033 | A | 8/1981 | Neyhart et al. | |
| 4,291,110 | A | 9/1981 | Lee | |
| 4,299,897 | A | 11/1981 | Stolka et al. | |
| 4,306,008 | A | 12/1981 | Pai et al. | |
| 4,338,387 | A | 7/1982 | Hewitt | |
| 4,439,507 | A | 3/1984 | Pan et al. | |
| 4,587,189 | A | 5/1986 | Hor et al. | |
| 4,664,995 | A | 5/1987 | Horgan et al. | |
| 4,889,784 | A * | 12/1989 | Champ et al. | 430/58.45 |
| 5,013,624 | A * | 5/1991 | Yu | 430/60 |
| 5,055,366 | A * | 10/1991 | Yu et al. | 430/58.8 |
| 5,473,064 | A | 12/1995 | Mayo et al. | |
| 5,521,043 | A | 5/1996 | Listigovers et al. | |
| 5,798,200 | A * | 8/1998 | Matsuura et al. | 430/126 |
| 5,830,614 | A | 11/1998 | Pai et al. | |
| 5,935,748 | A * | 8/1999 | Yu et al. | 430/69 |
| 6,015,645 | A | 1/2000 | Murti et al. | |
| 6,300,027 | B1 * | 10/2001 | Chambers et al. | 430/58.2 |
| 6,780,554 | B1 * | 8/2004 | Tong et al. | 430/58.8 |
| 6,893,736 | B1 * | 5/2005 | Konarski | 428/620 |
| 7,033,714 | B1 * | 4/2006 | Horgan et al. | 430/58.3 |
| 2004/0126684 | A1 * | 7/2004 | Horgan et al. | 430/58.3 |

OTHER PUBLICATIONS

Diamond, A.S., ed., *Handbook of Imaging Materials*, Marcel Dekker, Inc., NY (1991), pp. 395-396.*

* cited by examiner

*Primary Examiner*—Janis L. Dote
(74) *Attorney, Agent, or Firm*—Eugene O. Palazzo; Fay, Sharpe, Fagan, Minnich & McKee, LLP

(57) ABSTRACT

An electrophotographic imaging member having a charge generating layer and a charge transport layer overlayed thereon is provided. The charge transport layer has a lower surface and an upper surface, wherein the lower surface is in contiguous contact with the charge generating layer. The charge transport layer comprises a film forming polymer binder and a charge transport compound molecularly dispersed or dissolved therein to form a solid solution. The concentration of the charge transport compound in the charge transport layer decreases from the lower surface to the upper surface. In such a construction, the resulting charge transport layer exhibits enhanced cracking suppression, improved wear resistance, excellent imaging member electrical performance, and improved copy print out quality.

30 Claims, 4 Drawing Sheets

IMAGING MEMBERS

BACKGROUND

There is disclosed herein an imaging member used in electrophotography having a charge transport layer with multiple concentrations of charge transport compounds. More particularly disclosed herein is an imaging member that has a photogenerating layer and a charge transport layer with one or more regions or layers. In each region or layer, the charge transport compounds are molecularly dispersed or dissolved in a polymer binder to form a solid solution. In the resulting charge transport layer, the region or layer closest in proximity to the photogenerating layer is in contiguous contact therewith and comprises the highest concentration of charge transport compounds in a solid solution. The concentration of the charge transport compounds decreases from the region or layer in closest proximity to the photogenerating layer to the upper regions or layers of the charge transport layer.

A typical electrophotographic imaging member device comprises at least one photoconductive insulating layer. It is imaged by uniformly depositing an electrostatic charge on the imaging surface of the electrophotographic imaging member and then exposing the imaging member to a pattern of activating electromagnetic radiation, such as, light which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member such as paper.

A number of current electrophotographic imaging members are, for example, the multilayered photoreceptors that, in a negative charging system, comprise a substrate support, an electrically conductive layer, an optional charge blocking layer, an optional adhesive layer, a charge generating layer, a charge transport layer, and optional protective or overcoating layer(s). The imaging members of multilayered photoreceptors can take several forms, for example, flexible belts, rigid drums, flexible scrolls, and etc. Flexible photoreceptor belts may either be seamed or seamless belts. An anti-curl layer may, for example, also be employed on the back side of the flexible substrate support, the side opposite to the electrically active layers, to achieve the desired photoreceptor belt flatness.

Multilayered photoreceptors, when functioning under electrophotographic imaging machine service conditions, do typically exhibit mechanical failures such as frictional abrasion, wear, and surface cracking. Surface cracking is unique only in belt photoreceptors and is induced either due to dynamic fatigue of the belt flexing over the supporting rollers of a machine belt support module or caused by exposure to airborne chemical contaminants as those photoreceptor segments directly bend over the rollers after periods of photoreceptor belt non-use during machine idling. These chemical contaminants include solvent vapors and corona species emitted by machine charging subsystems. Surface cracking can also be exacerbated by the combination of the effects provided by fatigue belt flexing and airborne chemical exposure. In fact, the problem of photoreceptor surface cracking is a critical mechanical issue seen in imaging members, particularly, in flexible belts, because the cracks manifest themselves into printout defects that seriously impact copy quality.

REFERENCES

Various combinations of materials for the charge generating layers and charge transport layers have been disclosed. U.S. Pat. No. 4,265,990, the disclosure of which is totally incorporated herein by reference, illustrates a layered photoreceptor having a separate charge generating layer (CGL) and a separate charge transport layer (CTL). The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,265,990, 4,233,384, 4,306,008, 4,299,897 and 4,439,507, the disclosures of each of these patents being totally incorporated herein by reference in their entirety.

In multilayer photoreceptor devices, one property of value, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization can establish an upper limit to the concentration of the transport molecules that can be dispersed in a binder. There is also desired an imaging member that exhibits excellent performance properties and minimizes lateral conductivity migration of the charge image pattern.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene (DI3) in an amount of from about 1 part to about 10 parts, and preferably about 4 parts DI3, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

U.S. Pat. No. 5,830,614, the disclosure of which is further incorporated herein by reference, relates to a charge transport having two layers for use in a multilayer photoreceptor. The photoreceptor comprises a support layer, a charge generating layer, and two charge transport layers. The charge transport layers consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first charge transport layer. In the '614 patent, the hole transport compound is connected to the polymer backbone to create a single giant molecule of hole transporting polymer.

However, while the abovementioned references attempt to offer solutions to the problems noted, they frequently create new ones. Therefore, notwithstanding the above, there remains a need to provide an improved material for formulating a charge transport layer of an imaging member that exhibits enhanced performance properties and which is more tolerant to failures caused by mechanical and electrical stresses, has enhanced coating thickness uniformity, reduce imaging member surface cracking and an increased functional life.

SUMMARY

There is disclosed herein an effective solution to one or more of the abovementioned problems which extends the functional life of an electrophotographic imaging member under its service environment. Although the solutions disclosed herein are applicable to electrophotographic imaging members in either flexible belt configuration or rigid drum form, for reason of simplicity, the discussions below are focused only upon electrophotographic imaging members in flexible belt designs.

In one embodiment disclosed herein, there is provided an imaging member comprising a charge generating layer and a charge transport layer deposited thereon. The charge transport layer has a lower surface which is in contiguous contact with the charge generating layer, and an upper surface. Additionally, the charge transport layer comprises a film forming binder and a charge transport compound molecularly dispersed or dissolved therein to form a solid solution. The concentration of the charge transport compound in the charge transport layer decreases, such as by a decreasing concentration gradient, from the lower surface to the upper surface.

Further disclosed herein is an electrophotographic imaging member comprising a photogenerating layer and a solid solution charge transport layer having multiple regions of different concentrations of charge transport materials. The charge transport layer comprises a solid solution of different compositions and/or concentrations of charge transport materials, film forming polymer binders resins and other compounds to form two or more regions. In the resulting charge transport layer, the region closest in proximity to the contiguous photogenerating layer comprises the highest concentration of charge transport compounds in a solid solution. The concentration of the charge transport materials then progressively decreases from the region closest in proximity to the photogenerating layer to the upper region of the charge transport layer. This results in a charge transport layer having a descending concentration gradient of charge transport materials included therein as the distance of the regions from the photogenerating layer increases.

In another embodiment, the charge transport layer comprises different regions or layers of a solid solution of a film forming polymer binder containing different concentrations of charge transport compounds wherein the layered amount of the largest concentration of charge transport compounds is at the bottom surface of the charge transport layer in the region or area in closest proximity to, and in contiguous contact with, the photogenerating layer, and the least amount is at the top surface of the charge transport layer. The concentration of charge transport compounds then progressively decreases from the bottom surface to the top surface of the charge transport layer. This thereby produces a descending concentration gradient of the charge transport compounds toward the top surface of the charge transport layer.

In a further embodiment, the charge transport layer can comprise multiple charge transport layers consisting of a first or bottom charge transport layer comprised of a solid solution of a film forming polymer binder and a charge transport component, and thereover and in contact with the first layer, a plurality of additional solid solution charge transport layers. These additional charge transport layers comprise two or more distinctive layers, each can consist of same or different film forming polymer binder and same or different charge transport component as that of the first charge transport layer. However, in the layers, the content of charge transport component is reduced in a stepwise, or graduated, concentration gradient from the first layer located in closest proximity to the photogenerating layer to the top or uppermost layer. The plurality of the additional charge transport layers comprises from at least 2 to about 15 layers and, more specifically, from about 2 to about 4 layers.

The plurality of additional charge transport layers in the charge transport layer may also contain a stabilizing antioxidant such as a hindered phenol. Such a phenol is present in a reversed concentration gradient as that of the charge transport compound. For example, while the concentration of the charge transport compound decreases from the first or bottom layer (or the layer in closest proximity to the photogenerating layer) to the top layer in the overall charge transport layer, the concentration of the hindered phenol increases in the same direction. Furthermore, in order to achieve enhanced wear resistance results, the top or uppermost layer or region of the charge transport layer may further include particles dispersions of silica, PTFE, and wax polyethylene for effective lubrication and wear life extension.

In another embodiment disclosed herein is an electrophotographic imaging member comprised of an optional supporting substrate, an optional hole blocking layer, an optional adhesive layer, a photo (or charge) generating layer, and a charge transport layer comprised of a solid solution. The solid solution charge transport layer comprises a single layer having a continuum of descending concentration of charge transport compound present therein as the distance from the photogenerating layer increases. In such an embodiment, the greatest amount of charge transport compound is located at the lower surface which is in contiguous contact with the photogenerating layer and the least amount is located at the upper surface of the charge transport layer. This particular result is achieved through the utilization of a coating process disclosed in more detail below.

Alternatively, in another embodiment, several layers or sublayers such as a first or bottom charge transport layer and thereover a plurality of additional charge transport layers can be utilized. In the additional charge transport layers, a graduated amount of a charge transport component, such as a hole transport compound, is present in a film forming binder capable of forming a binary solid solution with the hole transport compound. In other embodiments, further suitable components, such as a stabilizing hindered phenol, may be present. The amount of hole transport compound that is present in the first or bottom charge transport layer in contact with the photogenerating layer is higher than the amount of charge transport compound contained in the plurality of the additional charge transport layers. In such an embodiment, the lowest amount of charge transport compound is contained in the top layer of the plurality of additional layers and in a stepwise reduction in concentration to the first or bottom charge transport layer. This is preferably accomplished through the application of a coating process also disclosed herein.

In additional embodiments, antioxidants may also be present in the regions or layers of the charge transport layer. In these embodiments, the amount or concentration of the antioxidants, such as the hindered phenol is present in the lowest amount in the first or bottom charge transport region or layer and is present at higher or increasing amounts in the succeeding charge transport regions or layers, with the highest amount of the hindered phenol being present in the top charge transport region or layer.

Advantages associated with the imaging members of the present disclosure include for example, the avoidance or effectual suppression of early onset of charge transport layer cracking. Such cracking or micro-cracking can be initiated by the interaction with effluent of chemical compounds, such as exposure to volatile organic compounds, like solvents, selected for the preparation of the members and corona emissions from machine charging devices. The micro-cracks are for example from about 5 to about 10 micrometers in width, and from about 500 to about 800 micrometers in length. They result in copy print out defects and also adversely affect other functional characteristics of the imaging member. The imaging member disclosed herein also minimizes light shock by the addition to the top charge transport layers, light shock resisting or reducing agents, such diphenyl quinone and the like. The disclosure also produces excellent electrical, and mechanical characteristics and copy print out quality enhancements.

Further advantages include the avoidance of or minimal undesirable migration of the hindered phenol to the photogenerating layer to thereby avoid imaging member instability, such as electrical performance degradation, and undesirable electrical characteristics especially on long term cycling of the member. Moreover, the coating of the transport layers in separate passes minimizes the transport layers thickness variations. These variations can cause image defects referred to as rain drops. The disclosure also avoids an increase in the lateral surface conductivity of the member which in turn can cause image degradation, referred to as lateral conductivity migration (LCM). The disclosure further provides robust mechanical function such as such as, for example, suppress charge transport layer cracking as a result of fatigue function and chemical vapor attack as well as enhance wear resistance to effect imaging member service life extension.

Processes of imaging, especially xerographic imaging and printing, including digital, are also encompassed by the present disclosure. More specifically, the layered photoconductive imaging members of the present development can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

Other embodiments disclosed herein relate to the preparation of flexible electrophotographic imaging members utilizing a single charge transport layer of binary solid solution prepared from a film forming binder and a charge transport component, wherein the charge transport layer has a continuum reduction in concentration profile of from being the highest at the bottom to the lowest at the top of the layer. Additionally, disclosed herein is a charge transport layer having additional layers comprising a stepwise decrease in charge transport component content from bottom to the top of the overall charge transport layer. The fabricated imaging member includes flexible belts which posses a number of the advantages illustrated herein inclusive of excellent performance properties and which members are less susceptible to the development of mechanical and electrical stresses, improved in surface wear resistance, effectual suppression of early onset of imaging member surface cracking, and mechanical robustness to provide life longevity of the imaging members functioned under a normal machine service environment.

BRIEF DESCRIPTION OF THE DRAWINGS

A more complete understanding of the apparatus, process, and tools employed to yield the intended imaging member improvement outcome can be realized by reference to the accompanying drawings wherein.

DETAILED DESCRIPTION

Figure 1:
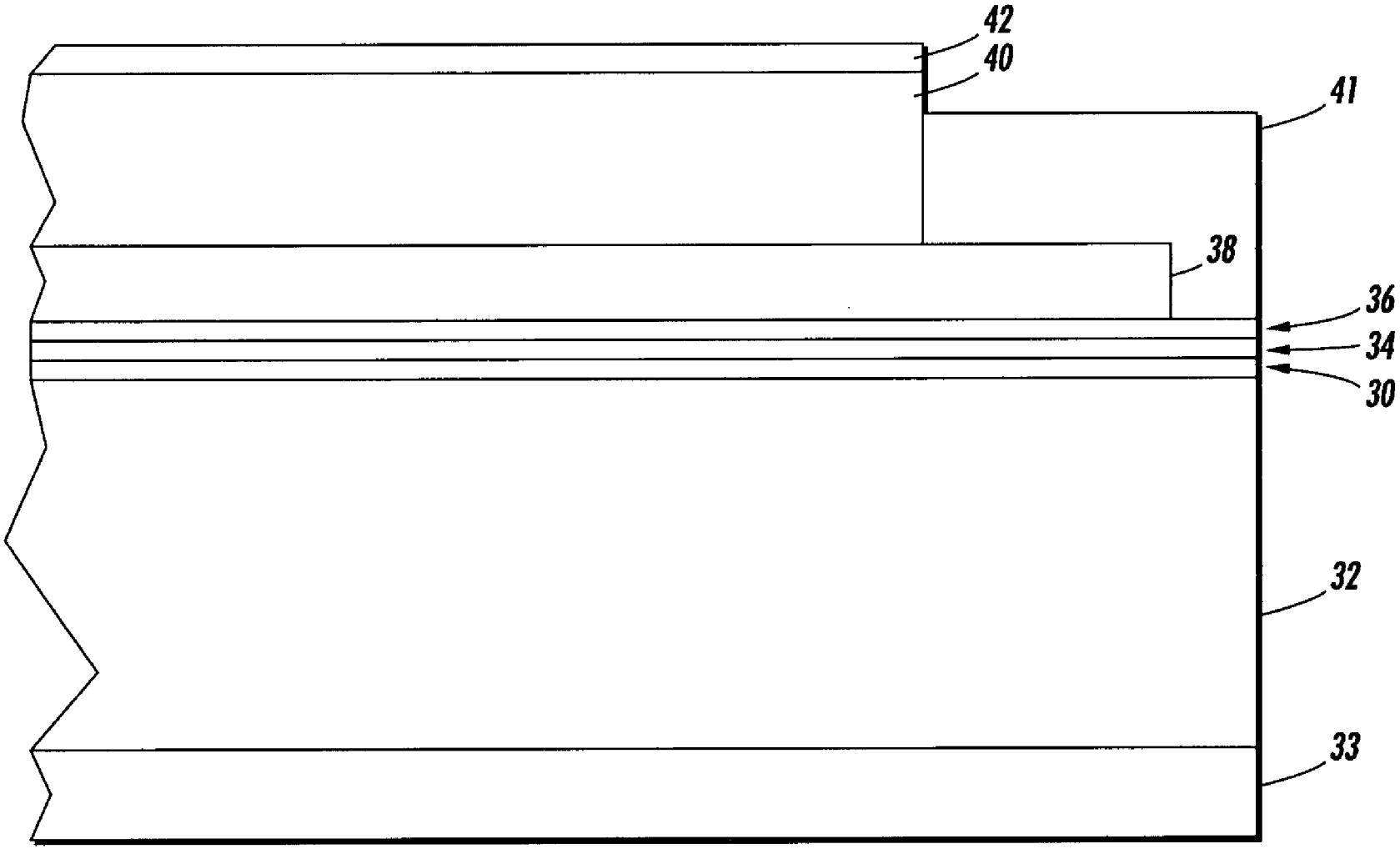
FIG. 1 is a schematic cross-sectional view of an exemplary embodiment of an imaging member, having a single layer charge transport layer, of the present disclosure. This figure is merely a schematic representation based on convenience and the ease of demonstrating the present disclosure, and is, therefore, not intended to indicate relative size and dimensions of the imaging member or components thereof.

Although specific terms are used in the following description for clarity purpose, these terms are intended to refer only to the particular structure of the development selected for illustration in the drawings and not to define or limit the scope of the disclosure. Furthermore, the same numerical numbers are used to identify same structure unless specified otherwise; it should also be noted that the relative dimensions of the structure are intentionally not drawn according to their relative proportion for the ease of discussion.

This detailed disclosure relates to a negatively charged flexible electrophotographic imaging member. The flexible electrophotographic imaging member includes a substrate support, a multilayered photoimaging layer, and an optionally, optically transparent anti-curl back coating. The term optically transparent is defined herein as the capability of the anti-curl back coating to transmit at least about 98 percent of an incident light energy through the coating. The anti-curl back coating includes a film forming thermoplastic polymer and has a glass transition temperature (Tg) value of at least about 75° C., a thermal contraction coefficient value of at least about 1.5 times greater than the thermal contraction coefficient value of the substrate support, a Young's Modulus of at least about 2×105 pounds per square inch (p.s.i.), and adheres well over the supporting substrate to give a 180° peel strength value of at least about 15 grams/centimeter (g/cm).

The multilayered photoimaging layer includes a photogenerating layer, and a charge transport layer. The multilayered photoimaging layer may also include the following optional layers: a conductive layer, a hole blocking layer, an adhesive layer, an overcoat layer, and/or a ground strip layer.

This disclosure also relates to a process for making a flexible electrostatographic imaging member. This process involves providing a substrate support having a first major surface and a second major surface. A multilayered photoimaging layer is then applied to the substrate support's first major surface and an optional, optically transparent anti-curl back coating is applied to the substrate support's second major surface.

For the sake of convenience, the disclosure will be described only for electrophotographic imaging members in flexible belt form even though this development includes electrostatographic imaging members of different material configurations.

An exemplary embodiment of the multilayered electrophotographic imaging member of flexible belt configuration of the present disclosure is illustrated in FIG. 1. In this figure, the thickness of the substrate support 32 depends on numerous factors, including mechanical strength, flexibility, and economical considerations; and thereby, this layer for a flexible belt may, for example, have a thickness of at least about 50 micrometers, or of a maximum thickness not greater than about 150 micrometers, provided there are no adverse effects on the final electrophotographic imaging device.

The substrate support 32 is not soluble in any of the solvents used in each coating layer solution, is optically transparent, and is thermally stable up to a high temperature of about 150° C. A typical substrate support 32 used for imaging member fabrication has a thermal contraction coefficient ranging from about $1\times10^{-5}$/° C. to about $3\times10^{-5}$/° C. and a Young's Modulus of between about $5\times10^{-5}$ psi and about $7\times10^{5}$ psi.

The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 Angstrom units and about 750 Angstrom units, and more specifically between about 50 Angstrom units and about 200 Angstrom units for an optimum combination of electrical conductivity, flexibility and light transmission. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

After formation of an electrically conductive surface, a hole blocking layer 34 may be applied thereto. Any suitable hole blocking layer capable of forming an effective barrier to holes injection from the adjacent conductive layer into the photoconductive or photogenerating layer may be utilized. Examples of hole blocking layer may includes materials such as gamma amino propyl triethoxyl silane, zinc oxide, titanium oxide, silica, polyvinyl butyral, phenolic resins, and the like. The hole blocking layer of nitrogen containing siloxanes or nitrogen containing titanium compounds are as disclosed, for example, in U.S. Pat. No. 4,291,110, U.S. Pat. No. 4,338,387, U.S. Pat. No. 4,286,033 and U.S. Pat. No. 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of between about 0.2 and about 2 micrometers.

An optional adhesive layer 36 may be applied to the hole blocking layer. Any suitable adhesive layer may be utilized. One well known adhesive layer includes a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000. If desired, the adhesive layer may include a copolyester resin. The adhesive layer including the polyester resin is applied to the blocking layer. Any adhesive layer employed should be continuous and, more specifically, have a dry thickness between about 200 micrometers and about 900 micrometers and, even more specifically, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air drying, and the like.

Any suitable photogenerating layer 38 may be applied to the blocking layer 34 or adhesive layer 36, if one is employed, which can thereafter be overcoated with a contiguous hole transport layer. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. Any suitable charge generating binder layer including photoconductive particles dispersed in a film forming binder may be utilized. For the charge generating binder layer, photoconductive particles such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are appropriate because of their sensitivity to white light. Vanadyl phthalocyanine, metal free phthalocyanine and tellurium alloys are also useful because these materials provide the additional benefit of being sensitive to infrared light. The photogenerating materials selected should be sensitive to activating radiation having a wavelength between about 600 and about 700 nm during the imagewise radiation exposure step in a electrophotographic imaging process to form an electrostatic latent image.

Any suitable inactive resin materials may be employed in the photogenerating layer 38 including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidene-chloride copolymers, styrene-alkyd resins, and the like.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and more specifically from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally ranges in thickness of from about 0.1 micrometer to about 5 micrometers, and more specifically has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present development are achieved.

The charge transport layer 40, applied over the charge generating layer 38, may include any suitable transparent organic polymer or non-polymeric material capable of supporting the injection of photogenerated holes from the charge generating layer 38 and capable of allowing the transport of these holes through the charge transport layer to selectively discharge the surface charge on the imaging member surface. The charge transport layer 40 not only serves to transport holes, but also protects the charge generating layer 38 from abrasion or chemical attack and therefore extends the service life of the imaging member. The charge transport layer 40 should exhibit negligible, if any, discharge when exposed to a wavelength of light useful in xerography, e.g., about 4000 Angstroms to about 9000 Angstroms. Therefore, the charge transport layer is substantially transparent to radiation in a region in which the photoconductor is to be used. Furthermore, the charge transport layer 40 is a substantially non-photoconductive material, but supports the injection of photogenerated holes from the charge generation layer 38. The charge transport layer 40 is required to be transparent when exposure is effected through this active layer to ensure that most of the incident radiation is utilized by the underlying charge carrier generator layer 38 below to produce efficient photogeneration outcome. The charge transport layer 40 in conjunction with the generation layer 38 in the instant development is a material which is an insulator to the extent that an electrostatic charge placed on the transport layer is not conducted in the absence of illumination.

The charge transport layer 40 may include any suitable activating compound useful as an additive molecularly dispersed in an electrically inactive polymeric material to form a solid solution and thereby making this material electrically active. The activating compound may be added to a film forming polymeric material which is otherwise incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active transport layer 40 in order to discharge the surface charge on this active transport layer.

The charge transport layer 40 of this disclosure is comprised of more than one region or layer formed of a binary solid solution comprised of a film forming polymer binder and a hole mobility organic charge transporting compound. Examples of such charge transporting compounds include triphenylmethane, bis(4-diethylamine-2-methylphenyl) phenylmethane, stilbene, and hydrazone; otherwise, an aromatic amine comprising Tritolylamine; arylamine; enamine phenanthrene diamine; N,N'-bis-(3,4-dimethylphenyl)-4-biphenyl amine; N,N'-bis(4-methylphenyl)-N,N'-bis(4-ethylphenyl)1,1'-(3,3'-dimethylbiphenyl)-4,4'-diamine; 4-4'-bis (diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(4-methylphenyl)-1,1'-biphenyl-4,4'-diamine; N,N'-diphenyl-N,N'-bis (alkylphenyl)-1,1'-biphenyl-4,4'-diamine; and N,N'-diphenyl-N,N'-bis(chlorophenyl)-1,1'-biphenyl-4,4'-diamine. Since the last two aromatic diamines are commonly used hole transporting compound for typical electrophotographic imaging member fabrication, they are selected for present disclosure embodiment preparation and are thereby represented by the molecular Formula I below:

FORMULA I

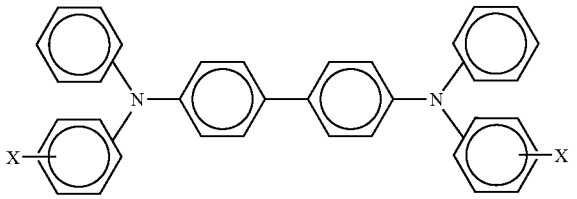

wherein X is selected from the group consisting of alkyl, hydroxy, and halogen.

Alternatively, electrophotographic imaging member may comprise a novel terphenyl diamine charge transporting compound, having enhanced hole transporting capacity (about 50% hole mobility improvement) than those aromatic diamines described above. Such a compound is suitable for this development application because the enhanced hole transport capability will allow its usage in the top charge transport layer formulation be reduced to effect mechanical property improvement without causing deleterious photoelectrical impact to the fabricated imaging member. The high hole mobility transporting terphenyl diamine is represented by the molecular Formula II below:

FORMULA (II)

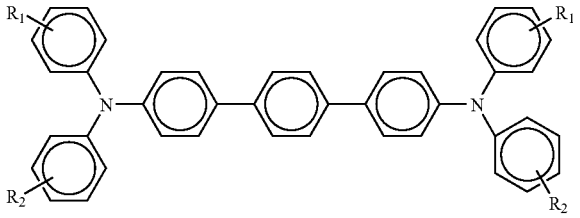

wherein R1 is an alkyl which optionally contains from 1 to about 10 carbon atoms and R2 is an alkyl which optionally contains from 1 to about 10 carbon atoms. Formula (II) includes, among others, N,N'-bis(4-methylphenyl)-N,N'-bis [4-(1-butyl)-phenyl]-[p-terphenyl]-4,4"-diamine, N,N'-bis (3-methylphenyl)-N,N'-bis[4-(1-butyl)-phenyl]-[p-terphenyl]-4,4"-diamine, N,N'-bis (4-t-butylphenyl)-N,N'-bis[4-(1-butyl)-phenyl]-[p-terphenyl]-4,4"-diamine, N,N',N",N'"-tetra[4-(1-butyl)-phenyl]-p-terphenyl]-4,4"-diamine, and N,N',N", N'"-tetra[4-t-butyl-phenyl]-[p-terphenyl]-4,4"-diamine.

The charge transport layer 40 may also include any suitable activating compound useful as an additive dispersed in electrically inactive polymeric materials making these materials electrically active. Any suitable inactive resin binder soluble in methylene chloride, chlorobenzene or other suitable solvent may be employed in the process of this disclosure. Typical inactive resin binders include polycarbonate resin, polyvinylcarbazole, polyester, polyarylate, polyacrylate, polyether, polysulfone, and the like. Molecular weights can vary, for example, from about 20,000 to about 1,500,000.

Other layers such as conventional ground strip layer 41 including, for example, conductive particles dispersed in a film forming binder may be applied to one edge of the imaging member to promote electrical continuity with the conductive layer 30 through the hole blocking layer 34, and adhesive layer 36. Ground strip layer 41 may include any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

Optionally, an overcoat layer 42, if desired, may also be utilized to provide imaging member surface protection as well as improve resistance to abrasion.

Further aspects of the exemplary embodiments as illustrated herein relate to an imaging member comprising, a supporting flexible substrate having a conductive surface or layer, an optional hole blocking layer, an optional adhesive layer, a charge generating layer, and a charge transport layer 40 which comprises multiple concentration regions of a binary solid solution comprising a film forming polymer binder and an aromatic amine hole transporting compound of Formula I or any one of the aromatic diamines given above. The charge transport layer 40 contains a region of highest concentration, from about 50 to about 90 weight, hole or charge transport compound near the bottom surface and has a continuum of decreasing concentration of hole or charge transport compound towards the top surface of the layer. This results the production of a region having the lowest aromatic diamine concentration, from about 5 and 10 weight percent, near the top surface of the charge transport layer 40.

In another embodiment illustrated herein, the hole transport compound used in the charge transport layer 40 of the imaging member in FIG. 1 is a terphenyl diamine of Formula II, wherein the region of the highest hole transport compound concentration, from about 40 to about 80 weight, is near the bottom surface. The concentration of the hole transport compound is then continuously decreased to produce a region having the lowest terphenyl diamine content of from about 2 and 8 weight percent near the top surface of the multiple charge transport layer 40. Therefore, the reduction, near the top, and coupled with the increase, near the bottom, of the amount of hole transport compound presence in the charge transport layer 40 produces the mechanical property enhancement that suppresses the early onset of charge transport layer cracking problem and effects functional life longevity outcome without negatively impacting the electrophotographic performance of the imaging member.

A further embodiment illustrated herein relates to the inclusion in the charge transport layer of variable amounts of an antioxidant such as a hindered phenol comprises of octadecyl-3,5-di-tert-butyl-4-hydroxyhydrociannamate, available as IRGANOX I-1010 from Ciba Specialty Chemicals, in the charge transport layer 40 (of about 10 weight percent with respect to the hole transport compound content). The presence of IRGANOX I-1010 is tailored to produce a continuum of ascending concentration of the antioxidant in reversal to that of the hole transport compound for maximizing the effect that yields electrical stability and minimize LCM impact.

Additional aspects relate to an imaging member, comprising a supporting flexible substrate having a conductive surface or layer and all its required coating layers, and a charge transport layer 40 consisting of various regions or layers, wherein the upper region or layer of the multiple charge transport layer is filled with nano particles dispersion, such as silica, metal oxides, ACUMIST (waxy polyethylene particles), PTFE, and the like. This is for the purpose of enhancing the lubricity and wear resistance of charge transport layer 40. The particle dispersion concentrated in the top vicinity of the upper region of charge transport layer 40 should not exceed 10 weight percent of the weight of the top region or one tenth thickness of resulting single charge transport layer 40 to render optimum wear resistance benefit without causing deleterious electrical impact of the fabricated imaging member.

The charge transport layer 40 of the present disclosure should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is more specifically maintained from about 2:1 to about 200:1 and in some instances as great as about 400:1. Therefore, it is generally that the thickness of the charge transport layer is between about 5 micrometers and about 100 micrometers, but thickness outside this range can also be used provided that there are no adverse effects.

The charge transport layer 40 is, generally, a solid solution including an activating organic compound molecularly dissolved in a polycarbonate binder of either a poly(4,4'-isopropylidene diphenyl carbonate) or a poly(4,4'-diphenyl-1,1'-cyclohexane carbonate). Typically, it has a Young's Modulus in the range of from about $2.5\times10^5$ psi to about $4.5\times10^5$ psi and with a thermal contraction coefficient of between about $6\times10^{-5}$/° C. and about $8\times10^{-5}$/° C. Since the charge transport layer 40 has a great thermal contraction mismatch compared to that of the substrate support 32, the prepared flexible electrophotographic imaging member is, at this point, seen to exhibit spontaneous upward curling due to the result of larger dimensional contraction in the charge transport layer 40 than the substrate support 32, as the imaging member cools down to room ambient temperature after the heating/drying processes of the applied wet charge transport layer coating. An anti-curl back coating 33 can be applied to the back side of the substrate support 32 (which is the side opposite the side bearing the electrically active coating layers) in order to render flatness.

The anti-curl back coating 33 may include any suitable organic or inorganic film forming polymers that are electrically insulating or slightly semi-conductive. The anti-curl back coating 33 used has a thermal contraction coefficient value substantially greater than that of the substrate support 32 used in the imaging member within a temperature range between about 20° C. and about 130° C. employed during imaging member fabrication layer coating and drying processes. To yield the designed imaging member flatness outcome, the applied anti-curl back coating has a thermal contraction coefficient of at least about 1½ times greater than that of the substrate support to be considered satisfactory; that is a value of at least approximately $+1\times10^{-5}$/° C. larger than the substrate support which typically has a substrate support thermal contraction coefficient of about $2\times10^{-5}$/° C. However, an anti-curl back coating with a thermal contraction coefficient at least about 2 times greater, equivalent to about $+2\times10^{-5}$/° C., than that of the substrate support is appropriate to yield an effective anti-curling result. The applied anti-curl back coating is a film forming thermoplastic polymer, being optically transparent, with a Young's Modulus of at least about $2\times10^5$ psi, bonded to the substrate support to give at least about 15 gms/cm of 180° peel strength. The anti-curl back coating is typically between about 7 and about 20 weight percent based on the total weight of the imaging member which corresponds to from about 7 to about 20 micrometers in coating thickness. The selected anti-curl back coating polymer is to be conveniently dissolved in any common organic solvent for the ease of coating solution preparation and is to be inexpensive, so as to provide effectual imaging member production cost cutting.

The selection of a thermoplastic film forming thermoplastic polymer for anti-curl back coating application should satisfy the physical, mechanical, optical, and thermal requirements, as detailed herein. Suitable polymer materials for use in the anti-curl back coating include: polycarbonates, polystyrenes, polyesters, polyamides, polyurethanes, polyarylethers, polyarylsulfones, polyarylate, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, and the like. These polymers may be block, random or alternating copolymers. In addition, other polymers may also include polycarbonate resin, polyvinylcarbazole, polyester, polyarylate, polyacrylate, polyether, polysulfone, polystyrene, polyamide, and the like. Molecular weights can vary from about 20,000 to about 150,000. Polycarbonates may be a bisphenol A polycarbonate material such as poly(4,4'-isopropylidene-diphenylene carbonate) having a molecular weight of from about 35,000 to about 40,000, available as LEXAN 145 from General Electric Company and poly(4,4'-isopropylidene-diphenylene carbonate) having a molecular weight of from about 40,000 to about 45,000, available as LEXAN 141 also from the General Electric Company. A bisphenol A polycarbonate resin having a molecular weight of from about 50,000 to about 120,000, is available as Makrolon from Farbenfabricken Bayer A.G. A lower molecular weight bisphenol A polycarbonate resin having a molecular weight of from about 20,000 to about 50,000 is available as MERLON from Mobay Chemical Company. Another type of polycarbonate of interest is poly(4,4-diphenyl-1,1'-cyclohexane carbonate), which is a film forming thermoplastic polymer structurally modified from bisphenol A polycarbonate; it is commercially available from Mitsubishi Chemicals. All of these polycarbonates have a Tg of between about 145° C. and about 165° C. and with a thermal contraction coefficient ranging from about $6.0\times10^{-5}$/° C. to about $7.0\times10^{-5}$/° C.

Furthermore, suitable film forming thermoplastic polymers for the anti-curl back coating 33, if desired, may include the same binder polymers used in the charge transport layer 40. The anti-curl back coating formulation may include the addition of a small quantity of a saturated copolyester adhesion promoter to enhance its adhesion bond strength to the substrate support.

Figure 2:
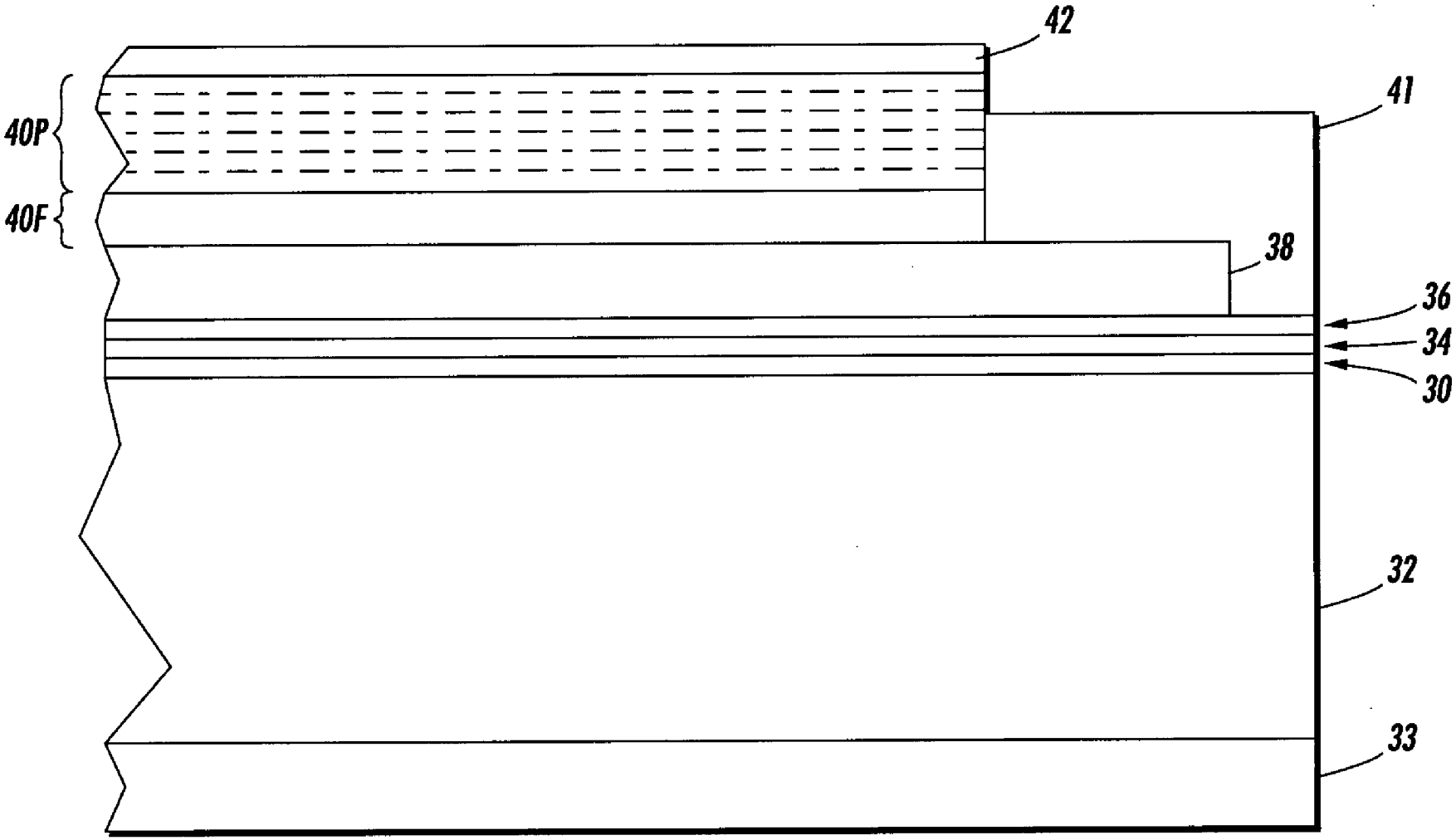
FIG. 2 is a schematic cross-sectional view of another exemplary embodiment of an imaging member of the present development. The imaging member, as illustrated, comprises a charge transport layer consisting of multiple layers.

In further embodiments, the flexible electrophotographic imaging members may alternatively comprise a charge transport layer having multiple layers according to the illustration presented in FIG. 2. In these embodiments, the charge transport layer comprises discrete, but contiguous layers.

An example of such an embodiment includes an imaging member comprising:

a supporting flexible substrate having a conductive surface or layer, an optional hole blocking layer, an optional adhesive layer, a charge generating layer, and a charge transport layer consisting of a first or bottom charge transport layer 40F and a plurality of additional charge transport layers 40P, all of which are solid solutions comprising the same film forming polymer binder and very same aromatic amine hole transporting compound of Formula I or any one of the aromatic diamines given above, wherein the first charge transport layer 40F comprises from about 50 to about 90 weight percent hole transport compound with respect to the total weight of the first layer 40F to give satisfactory hole transporting result, nonetheless, a content comprising about 60 to about 70 weight percent is preferred for achieving optimum function. By comparison, the first or base layer of the plurality of additional charge transport layers 40P is comprised of from about 40 to about 60 weight percent and then in stepwise reduction fashion of aromatic diamines concentration in each subsequent layer of the additional charge transport layers 40P to reach a lowest concentration of between about 10 and about 30 weight percent at the very top layer of the additional charge transport layers 40P with respect to the total weight of each respective layer. Therefore, the top charge transport layer of the plurality of additional charge transport layers 40P contains more polymer binder in the coating layer matrix to effect its mechanical property enhancement for suppression of early onset of charge transport layer cracking problem as well as improvement of wear resistance for its service life extension. An anti-curl back coating may also be required to counteract the imaging member upward curling and maintain flatness for a complete imaging member design. In one embodiment, the first charge transport layer contains from about 50 to about 90 weight percent of a charge transport component based on the weight of the first charge transport layer. In another embodiment, the first charge transport layer contains from about 60 to about 70 weight percent of a charge transport component. In another embodiment, the uppermost layer of the additional charge transport layers contains from about 10 to about 30 weight percent of charge transport components based on the weight of the uppermost layer. In another embodiment, the substrate has a thickness of from about 50 micrometers to about 300 micrometers. In another embodiment, the substrate has a thickness of from about 80 micrometers to about 120 micrometers. In another embodiment, the charge generating layer comprises metal free phthalocyanines, metal phthalocyanines, vandyl phthalocyanines, perylenes, titanyl phthalocyanines, hydroxy gallium phthalocyanines, selenium, selenium alloys, or mixtures thereof.

In a specific embodiment embodiments where the plurality of additional charge transport layers is from about 2 to about 3 layers, the uppermost layer of the additional charge transport layers contains from about 5 to about 25 weight percent of charge transport component based on the weight of the uppermost layer. In another embodiment where the plurality of additional charge transport layers is from about 2 to about 3 layers, the base layer of the additional charge transport layers contains from about 40 to about 60 weight percent of charge transport components. In another embodiment where the plurality of additional charge transport layers is from about 2 to about 3 layers, the base layer of the additional charge transport layers contains from about 30 to about 50 weight percent of charge transport components. In another embodiment where the plurality of additional charge transport layers is from about 2 to about 3 layers, the second layer of the additional charge transport layers contains from about 25 to about 45 weight percent of charge transport components. In another embodiment where the plurality of additional charge transport layers is from about 2 to about 3 layers, the second layer of the additional charge transport layers contains from about 20 to about 40 weight percent of charge transport components. In an embodiment having four additional charge transport layers, the fourth charge transport layer contains from about 15 to about 35 weight percent of charge transport components.

In another embodiment, the plurality of additional charge transport layers is 3 layers and wherein the base layer of the additional charge transport layer contains from about 40 to about 60 weight percent of said charge transport components, the second layer of the additional charge transport layers contains from about 30 to about 50 weight percent of said charge transport components, and the third layer of the additional charge transport layers contains from about 10 to about 30 weight percent by weight of said charge transport components and the first charge transport layer contains from about 50 to about 90 weight percent of said charge transport components.

In another embodiment, the plurality of additional charge transport layers is 3 layers, the base layer of the additional charge transport layers contains from about 30 to about 50 weight percent of said charge transport components, the second layer of the additional charge transport layers contains from about 10 to about 35 weight percent of said charge transport components, the third layer of the additional charge transport layers contains from about 5 to about 25 weight percent by weight of said charge transport components, and the first charge transport layer contains from about 40 to about 80 weight percent of said charge transport components.

Another aspect of charge transport layer for effectual mechanical function improvement illustrated herein relate to an imaging member comprising:

an optional supporting flexible substrate having a conductive surface or layer, an optional hole blocking layer, an optional adhesive layer, a charge generating layer, and a charge transport layer consisting of a first or bottom charge transport layer 40F and a plurality of additional charge transport layers 40P, all of which are solid solutions comprising the same film forming polymer binder, wherein the first charge transport layer 40F comprises aromatic amine hole transporting compound of Formula I or any of which aromatic diamines named above and the same concentration according to the description in the preceding embodiment, whereas the plurality of additional charge transport layers 40P comprise the high hole transporting terphenyl diamine of Formula II in such a way that the base layer of plurality of layers 40P comprises about 30 to 50 weight percent terphenyl diamine, and in stepwise reduction fashion of its concentration in each subsequent layer of layers 40P to reach a lowest concentration of between about 5 and about 25 weight percent at the very top layer of layers 40P. The prepared imaging member may also require an anti-curl back coating to maintain flatness.

Still another aspect of charge transport layer mechanical function improvement illustrated herein relate to an imaging member comprising:

a supporting flexible substrate having a conductive surface or layer, an optional hole blocking layer, an optional adhesive layer, a charge generating layer, and a charge transport layer consisting of a first or bottom layer 40F and a plurality of additional charge transport layers 40P, all of which are binary solid solutions comprising the same film forming polymer binder and same high hole transporting terphenyl diamine of Formula II, wherein the first charge transport layer 40F comprises an amount of terphenyl diamine from about 40 to about 80 weight percent, while the plurality of additional charge transport layers 40P consists of the same high hole transporting terphenyl diamine in same polymer binder in such a way that the first or base layer of the plurality of layers 40P comprises about 30 to 50 weight percent terphenyl diamine and in stepwise reduction fashion of its concentration in each subsequent layers to reach a lowest concentration of between about 5 and about 25 weight percent at the very top layer of the plurality of layers 40P, which is similar to the concentration gradient profile as that of the plurality charge transport layers 40P described in the above embodiment. The prepared imaging member may again require an anti-curl back coating to maintain flatness.

To achieve the desired outcome, it is necessary that each of the charge transport layers of the imaging member in FIG. 2 be solution coated, and then completely and fully dried at elevated temperature to remove the coating solvent prior to the application of the next coating layer. Subsequently thereafter, the very same coating procedure is repeated again for every one of all the subsequent layers to produce the multiple charge transport layers of this disclosure. Any suitable or innovative technique may be utilized to mix and thereafter apply the multiple charge transport layer coating mixture onto the charge generating layer 38. Typical application techniques for each charge transport layer include extrusion die coating, spraying, roil coating, wire wound rod coating, and the like. Drying of each deposited wet coating may be effected by any suitable conventional technique such as oven drying, infra red radiation drying, air drying and the like.

Referring back to FIG. 2, the plurality of charge transport layers 40P, having the stepwise descending concentration gradient of hole transport compound of from having the highest in the base layer to the lowest in the top layer as described in the embodiments above, is comprised of about 2 to about 15 discreet layers; but preferably to be between 2 and 7 layers, with optimum result from 2 to 3 layers. The thickness of the first or bottom charge transport layer 40F is between about 5 and about 10 micrometers. Although the thickness of the first charge transport layer 40F may be the same to the collective thickness of the plurality of charge transport layers 40P, it is however preferably to be different; while the thickness among each of the plurality of additional charge transport layers 40P may be different, nonetheless it is preferred to be identical of being between about 0.5 and 7 micrometers. To achieve optimum functional outcome, the total thickness of the first charge transport layer 40F and the plurality of additional charge transport layers 40P should be in the range of between about 10 and about 110 micrometers. In one embodiment, the first charge transport layer and each of the additional charge transport layers are of a thickness of from about 5 to about 10 micrometers. In one embodiment, the first charge transport layer and each of the additional charge transport layers are of the same thickness.

Still yet another aspect of the multiple charge transport layer having mechanical function improvement illustrated herein relate to an imaging member, comprising a supporting flexible substrate having a conductive surface or layer and with all the respective coating layers described in the preceding embodiments above may furthermore include an antioxidant, such as IRGANOX I-1010, to each of the plurality of additional charge transport layers in a stepwise ascending concentration gradient in reversal fashion to that of the charge transport compound, but its content is of only about 10 weight percent with respect to the hole transport compound content to maintain electrical stability and maximize LCM suppression effect.

Another further aspect of the charge transport layer having mechanical function improvement illustrated herein relate to an imaging member, comprising a supporting flexible substrate having a conductive surface or layer and with all its respective coating layers described in the preceding embodiments above may again include incorporation of nano particles dispersion, such as silica, metal oxides, ACUMIST (waxy polyethylene particles), PTFE, and the like of not to exceed 10 weight percent in the top layer of the plurality of additional charge transport layers 40P, based on the total weight of the top layer, so as to render wear resistance enhancement result of the top charge transport layer.

Figure 3:
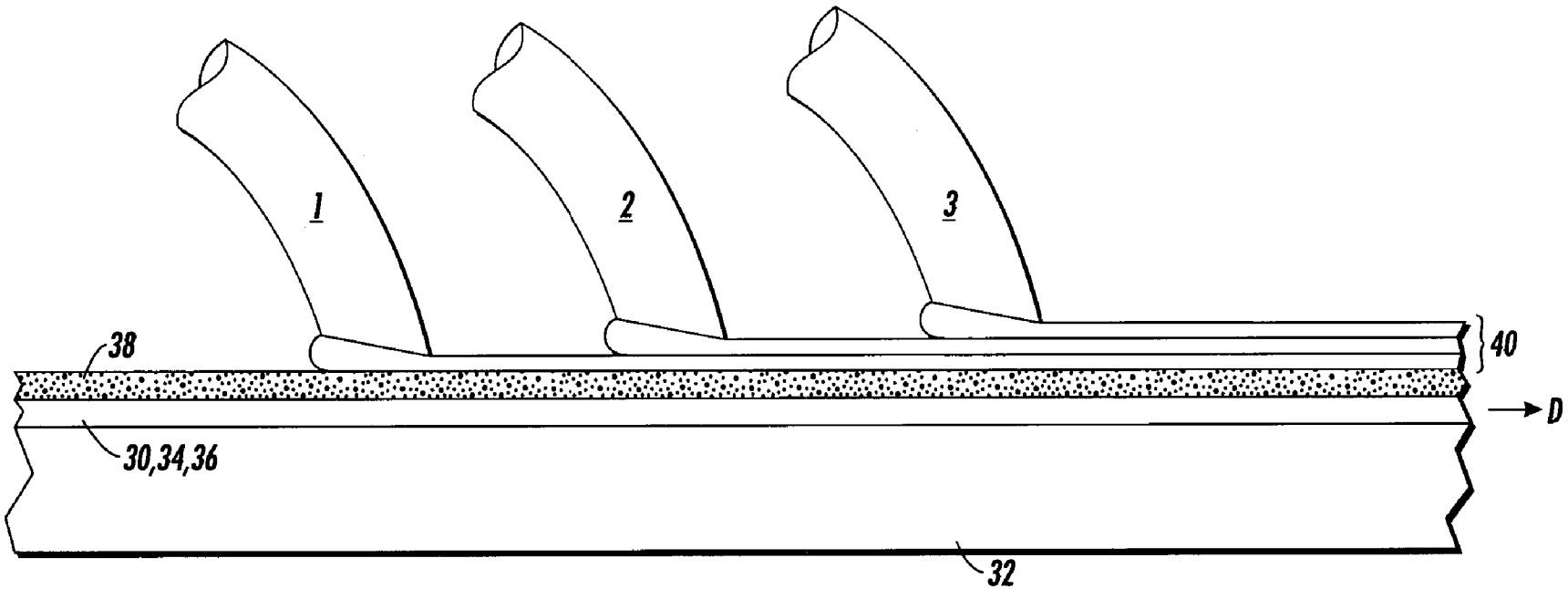
FIG. 3 is a schematic illustration of a process and the tools utilized to create an imaging member that comprises a single charge transport layer containing a continuum reduction in charge transport component concentration profile of being the highest content at the bottom surface and the lowest at the top surface of the layer.

Referring to FIG. 3 is a pictorial representation that illustrates the development process and tools employed to create an imaging member web stock of FIG. 1, having a single charge transport layer 40 which contains a continuum of descending hole transport compound concentration gradient profile from the bottom to the top of the layer in one single coating pass. As shown in the figure, the extrusion coating dies 1, 2, and 3 (although it may comprise of multiple dies of from about 2 to about 10 in tandem arrangement) are arranged in a subsequent fashion so that die 1 carries a solution of highest concentration of hole transport compound is extruded directly over the dried charge generation layer 38, while dies 2 and 3, each carrying a solution of descending hole transport compound concentration, dispenses each subsequent wet coating layer on top the respective prior wet coating layer as the imaging member web stock is moving in the arrow D pointing direction. The dies are positioned in close by vicinity to each other and arranged to have their predetermined descending concentrations, to produce the three applied charge transport layers in tandem, while they are not yet in fully dried state (defined as containing solvent of not less than 5 weight percent). This arrangement and process promotes the interfacial hole transport compound diffusion and leads to final convergence of these layers into a merging, charge transport layer 40, containing a descending hole transport compound concentration gradient profile (of from highest content near the bottom and lowest near the top) in the resulting dried charge transport layer 40 shown in the electrophotographic imaging member of FIG. 1. Alternatively, the charge transport layer coating application can be accomplished through utilizing a single coating die designed to consist of multiple slots that yields the intended development single charge transport layer coating result.

To create the desired ascending antioxidant, IRGANOX I-1010, concentration gradient continuum profile in the charge transport layer 40 in the imaging member of FIG. 1 by the innovative process shown in FIG. 3, die 1 should dispense a coating solution containing the least amount of IRGANOX, while additional amounts are dispersed from die 2 and higher amounts dispensed from die 3. For accomplishing wear property improvement outcome, particle dispersion is incorporated only into the coating solution in die 3 so that the resulting charge transport layer formed will have a particle dispersion concentrated only near the top surface of the single charge transport layer 40 to give maximized wear resistance enhancement function.

The multilayered, flexible electrophotographic imaging member web stocks having the charge transport layer designs fabricated, in accordance to the embodiments described in the preceding, to give enhanced physical and mechanical function, may be cut into rectangular sheets and each cut sheet is then brought together by overlapping and may be joined by any suitable means including ultrasonic welding, gluing, taping, stapling, and pressure and heat fusing to form a continuous imaging member seamed belt, sleeve, or cylinder, nevertheless, from the viewpoint of considerations such as ease of belt fabrication, short operation cycle time, and mechanical strength of the fabricated joint, the ultrasonic welding process is more specifically used to join the overlapping edges into a flexible imaging member seamed belt. The prepared flexible imaging belt may therefore be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure. For example, for positive development, charged toner particles are attracted to the oppositely charged electrostatic areas of the imaging surface and for reversal development, charged toner particles are attracted to the discharged areas of the imaging surface.

The development will further be illustrated in the following non-limiting examples, it being understood that these examples are intended to be illustrative only and that the disclosure is not intended to be limited to the materials, conditions, process parameters and the like recited herein. All proportions are by weight unless otherwise indicated.

CONTROL EXAMPLE I

An electrophotographic imaging member web stock was prepared by providing a 0.02 micrometers thick titanium layer coated on a biaxially oriented polyethylene naphthalate substrate (KALADEX, available from Dupont, Inc.) having a thickness of 3.5 micrometers (89 micrometers). Applied thereto, using a gravure coating technique, was a hole blocking layer generated from and a solution containing 10 grams of gamma aminopropyltriethoxy silane, 10.1 grams of distilled water, 3 grams of acetic acid, 684.8 grams of 200 proof denatured alcohol and 200 grams heptane. This layer was then allowed to dry for 5 minutes at 135 degrees Celsius (Centigrade) in a forced air oven. The resulting hole blocking layer had an average dry thickness of 0.05 micrometers measured with an ellipsometer.

An adhesive interface layer was then prepared by extrusion application to the hole blocking layer, a wet coating containing 5 percent by weight based on the total weight of the solution of polyester adhesive (MOR-ESTER 49,000, available from Morton International, Inc.) in a 70:30 volume ratio mixture of tetrahydrofuranicyclohexanone. The adhesive interface layer was allowed to dry for 5 minutes at 135 degrees Celsius in the forced air oven. The resulting adhesive interface layer had a dry thickness of 0.065 micrometers.

The adhesive interface layer was thereafter coated with a photogenerating layer. The photogenerating layer dispersion was prepared by introducing 0.45 grams of IUPILON 200 poly(4,4'-diphenyl)-1,1'-cyclohexane carbonate, available from Mitsubishi Gas Chemical Corp and 50 milliliters of tetrahydrofuran into a 4 ounce glass bottle. To this solution were added 2.4 grams of Hydroxygallium Phthalocyanine and 300 grams of ⅛ inch (3.2 millimeters) diameter stainless steel shot. This mixture is then placed on a ball mill for 20 to 24 hours. Subsequently, 2.25 grams of poly(4,4'-diphenyl)-1,1'-cyclohexane carbonate was dissolved in 46.1 grams of tetrahydrofuran, then added to this hydrogallium phthalocyanine slurry. This slurry was then placed on a shaker for 10 minutes. The resulting slurry was, thereafter, coated onto the adhesive interface by extrusion application process to form a layer having a wet thickness of 0.25 milliliters. However, a strip about 10 millimeters wide along one edge of the substrate web bearing the blocking layer and the adhesive layer was deliberately left uncoated by any of the photogenerating (or charge generating) layer material to facilitate adequate electrical contact by the ground strip layer that was applied later. This photogenerating layer was dried at 135 degrees Celsius for 5 minutes in a forced air oven to form a dry thickness photogenerating layer having a thickness of 0.4 micrometer layer.

This coated imaging member, at this point, was simultaneously coated onto with a charge transport layer and a ground strip layer using extrusion co-coating process. The charge transport layer was prepared by introducing into an amber glass bottle a weight ratio of 1:1 organic hole transport compound N,N'-diphenyl-N,N'-bis(3-methylphenyl)-1,1'-biphenyl-4,4'-diamine and MAKROLON 5705, a polycarbonate resin having a weight average molecular weight of about 120,000 commercially available from Bayer A. G. The resulting mixture was dissolved to give a 15 percent by weight solid in 85 percent by weight methylene chloride. This solution was applied onto the photogenerator layer to form a coating which upon drying gave a 30 micrometer thick binary solid solution charge transport layer and comprised of 50:50 weight percent hole transport compound to polymer binder ratio.

The approximately 10 millimeter wide strip of the adhesive layer left uncoated by the photogenerator layer was coated over with a ground strip layer during the co-coating process. This ground strip layer, after drying along with the co-coated hole transport layer at 135 degrees Celsius in the forced air oven for about 5 minutes, had a dried thickness of about 19 micrometers. This ground strip was electrically grounded by conventional means, such as, by a carbon brush contact during conventional xerographic imaging process. The imaging member, if unrestrained, at this point, did exhibit spontaneous upward curling into a 1½ inch roll.

An anticurl coating was prepared by combining 8.82 grams of polycarbonate resin (MAKROLON 5705, available from Bayer AG), 0.72 gram of polyester resin (VITEL PE-200, available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the anticurl coating solution. The anticurl coating solution was then applied to the rear surface (side opposite the photogenerator layer and hole transport layer) of the imaging member web stock, again by extrusion coating process, and dried at 135 degrees Celsius for about 5 minutes in the forced air oven to produce a dried film thickness of about 17 micrometers and render flatness. The resulting electrophotographic imaging member was used to serve as an imaging member control.

EXAMPLE II

Six charge transport layer solutions were prepared by following the same descriptive procedures and using the same materials as that of Control Example I, but with the exception that the solutions contain varying amounts of charge transport compound and were each applied over a Teflon® release surface by hand coating process to produce 30 micrometer thick free standing coatings, after drying, of 50, 40, 30, 20, 10, and 0 respective weight percent hole transport compound variance in each dried charge transport layer coating matrix. The prepared charge transport layer coatings were cut to give 1 inch×6 inch test samples and each of which was then subjected to low speed sample elongation testing, using an Instron Mechanical Tester. The exact extent of stretching at which the charge transport layer coating rupture occurred was recorded as break elongation of the coating for comparison.

The break elongation obtained for these coatings showed that the charge transport layer comprising the 50 weight percent control charge transport compound, at only 3.5 percent break elongation, was virtually a brittle coating layer; whereas reduction in hole transport compound did monotonously improve the coating's rupture resistance and became a highly stretchable coating with a 100 percent break elongation to resist tensile cracking when no hole transport compound was incorporated into the coating. These results indicated that simple removal of transport compound could effect the mechanical robustness of the charge transport.

EXAMPLE III

Five electrophotographic imaging members were prepared according to the procedures and using the same materials as that described in Control Example I, except that their charge transport layers contained descending content of 40, 30, 20, 10, and 0 weight percent hole transport compound in each respective layer. These prepared imaging members and the imaging member of Control Example I were cut to give 1 inch×6 inches samples, each of these samples was then subjected to low speed sample tensile elongation, using an Instron Mechanical Tester.

The exact extent of stretching at which onset of charge transport layer cracking in each of the six imaging member samples became evident when determined by examining the sample under 100× magnification using a stereo optical microscope in reflection mode. The charge transport layer cracking strains observed was about 3.25, 6.25, 10.5, 15.5, 63.5, 95.5 elongation percents, respectively, for the control and each of the samples containing the descending amount of 50, 40, 30, 20, 10, and 0 weight percent hole transport compound. These results were a further evidence to support the conclusion that improvement of an imaging member charge transport layer mechanical strength to resist tensile cracking could conveniently be achieved by reducing the content of the hole transport compound content in the layer. Additional experimental testing results obtained also showed that reduction of charge transport compound could give another added benefit to the charge transport layer resistive to wear.

Figure 4:
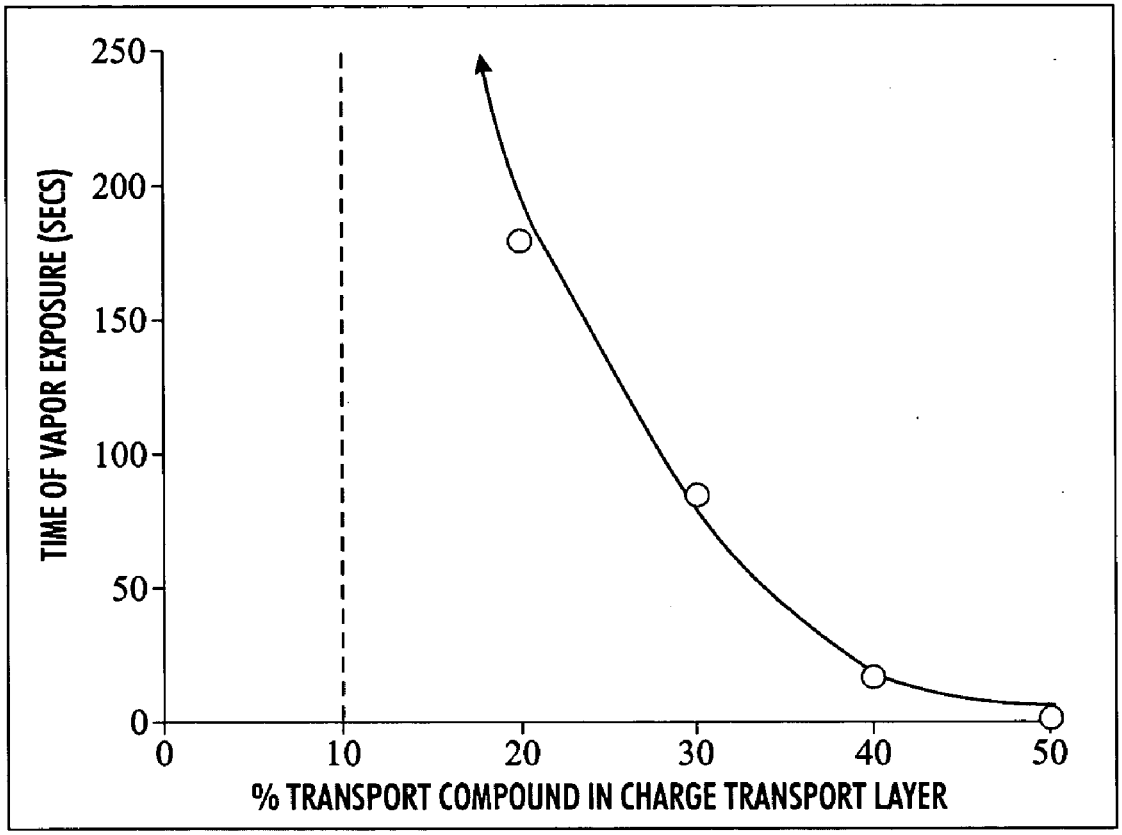
FIG. 4 is a plot illustrating the relationship between the onset time of charge transport layer cracking of bent imaging members (with their charge transport layers facing outwardly), containing different percentages of transport compound present in each respective charge transport layer, and the time of imaging member vapor exposure.

To evaluate the charge transport layer cracking resistance to solvent vapor exposure, the five prepared imaging members and the imaging member of Control Example I were cut to give 2 inches×3 inches test samples. Each of these test samples was rolled-up into a 19 mm tube, with the charge transport layer facing outwardly to induce bending strain, and then subjected to methylene chloride vapor exposure until the time that charge transport layer cracking became visually evident under 100× magnification with a stereo optical microscope. The results obtained, see FIG. 4, were evidence to indicate the fact that imaging member solvent vapor exposure charge transport layer cracking could effectively be suppressed by its charge transport compound reduction and absolute cracking elimination was achieved when the concentration of the charge transport compound was reduced to a low level of less than 20 weight percent.

All the above mechanical and solvent vapor exposure testing results did give strong evidence to conclude that physical and mechanical property improvements to provide effectual service life extension were conveniently achieved through hole transport compound reduction to suppress charge transport layer cracking and wear problems. Unfortunately, reduction of hole transport compound content to produce charge transport layer mechanical enhancement was found to cause electrical property degradation in the fabricated imaging member when loading level was dropped to and below 30 weight percent. To overcome this electrical shortfall, innovative concept was formulated to give disclosure imaging member designs as described in Example IV below.

EXAMPLE IV

A disclosure electrophotographic imaging member was prepared according to the procedures and using the same materials as that described in Control Example I, except that the charge transport layer was replaced by multiple charge transport layer. In the multiple charge transport layer comprised several layers with a charge transport gradient of from having the highest concentration in the first or bottom charge transport layer to a stepwise reduction that gave a lowest content in the top or surface charge transport layer. In essence, the first charge transport layer solution applied directly over the photogenerating layer, after fully drying, gave a 10 micrometer thick first charge transport layer containing a 70 weight percent hole transport compound; a subsequent second charge transport layer was then applied onto the first layer in identical fashion to give a 60 weight percent concentration dried layer of 10 micrometers in thickness; and lastly, a 10 micrometer dried top charge transport layer containing 20 weight percent was formed over the second charge transport layer, again in same manners, to create a 3 charge transport layers imaging member as a representation for this development.

Mechanical/Chemical and Electrical Evaluations

The disclosure electrophotographic imaging member of Example IV and the imaging member of Control Example I were assessed for dynamic fatigue charge transport layer cracking failure.

Each of these electrophotographic imaging members was cut to give a test sample size of 1 inch (2.54 cm.) by 12 inches (30.48 cm.) and each dynamically tested to the point that occurrence of fatigue charge transport layer cracking became evidence. Testing was effected by means of a dynamic mechanical cycling device in which free rotating (idle) rollers were employed to repeatedly bend and flex each imaging member test sample to induce fatigue strain in the charge transport layer as to simulate an imaging member belt cyclic function under a machine service condition. More specifically, one end of the test sample was clamped to a stationary post and the sample was then looped upwardly over three equally spaced horizontal idling rollers and then downwardly through a generally inverted "U" shaped path with the free end of the sample secured to a weight which provided one pound per inch width tension on the sample. The outer surface of the imaging member bearing the charge transport layer faced outwardly so that it would periodically be brought into dynamic bending/flexing contact as the idling rollers were repeatedly passing underneath the test sample to cause mechanical fatigue charge transport layer strain. The idling rollers had a diameter of one inch.

Each idling roller was secured at each end to an adjacent vertical surface of a pair of disks that were rotatable about a shaft connecting the centers of the disks. The rollers were parallel to and equidistant from each other and equidistant from the shaft connecting the centers of the disks. Although the disks were rotated about the shaft, each roller was secured to the disk but rotating freely around each individual roller axis. Thus, as the disk rotated about the shaft, two rollers were maintained at all times in rotating contact with the back surface of the test sample. The axis of each roller was positioned about 4 cm from the shaft. The direction of movement of the rollers along the charge transport layer surface was away from the weighted end of the sample toward the end clamped to the stationary post to maintain a constant one pound per inch wide sample tension. Since there were three idling rollers in the test device, each complete rotation cycle of the disk would produce three fatigue bending flexes strain in the charge transport layer since the segment of the imaging member sample was making a mechanical contact with only one single roller at a time during each testing cycle. The rotation of the spinning disk was adjusted to provide the equivalent of 11.3 inches (28.7 cm.) per second tangential speed. The onset of charge transport layer cracking was notable for the control sample after 105,000 bending flexes whereas the sample of the disclosure went beyond one million fatigue flexing free of charge transport layer failure.

Imaging members solvent vapor exposure testing was again carried out for the control and the imaging members of this disclosure by following the solvent vapor exposure test procedures described in Example III. It was found that the charge transport layer cracking resistance of the disclosed imaging member sample, comprising the multiple charge transport layers and with a top layer containing 20 weight percent hole transport compound, had out performed against the control imaging member sample counterpart having a standard 50 weight percent loaded charge transport layer.

Electrical Property of these electrophotographic imaging members was also determined. It is important to mention that no deleterious photo-electrical property impacts on charge acceptance, dark decay, residual/background voltages, photosensitivity, and long term cycling stability for the development imaging member was evident as compared to those results obtained for the control imaging member counterpart.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An imaging member comprising:

an electrically conductive substrate or a substrate comprising an electrically conductive layer;

a photogenerating layer; and, a charge transport layer deposited on the photogenerating layer, wherein the charge transport layer comprises a first charge transport layer comprised of a charge transport component and a film forming polymer binder, and thereover and in contact with the first charge transport layer, a plurality of additional charge transport layers, each comprised of a charge transport component and a film forming polymer binder, wherein the amount of charge transport component in said layers of the charge transport layer is the greatest in said first charge transport layer and progressively decreases to the uppermost layer of the additional charge transport layers; and wherein the charge transport layer further comprises a stabilizing hindered phenol, wherein the concentration of the hindered phenol increases from the first charge transport layer to the uppermost layer of the additional charge transport layers.

2. An imaging member in accordance with claim 1, wherein said first charge transport layer contains from about 50 to about 90 weight percent of a charge transport component based on the total weight of the first charge transport layer.

3. An imaging member in accordance with claim 1, wherein said first charge transport layer contains from about 60 to about 70 weight percent of a charge transport component based on the total weight of the first charge transport layer.

4. An imaging member in accordance with claim 1, wherein said plurality of additional charge transport layers is from about 2 to about 15 layers.

5. An imaging member in accordance with claim 1, wherein said plurality of additional charge transport layers is from about 2 to about 7 layers.

6. An imaging member in accordance with claim 1, wherein said plurality of additional charge transport layers is from about 2 to about 3 layers.

7. An imaging member in accordance with claim 6, wherein the uppermost layer of the additional charge transport layers contains from about 5 to about 25 weight percent of said charge transport component based on the total weight of the uppermost layer.

8. An imaging member in accordance with claim 6, wherein the second layer of the additional charge transport layers contains from about 25 to about 45 weight percent of said charge transport component based on the total weight of the second layer.

9. An imaging member in accordance with claim 6, wherein the third layer of the additional charge transport layers contains from about 20 to about 40 percent of said charge transport component based on the total weight of the third layer.

10. An imaging member in accordance with claim 1, wherein the uppermost layer of the additional charge transport layers contains from about 10 to about 30 weight percent of said charge transport component based on the total weight of the uppermost layer.

11. An imaging member in accordance with claim 1, wherein said plurality of additional charge transport layers is four layers and the fourth layer of the additional charge transport layers contains from about 15 to about 35 percent of said charge transport component based on the total weight of the fourth layer.

12. An imaging member in accordance with claim 1, wherein each of the layers of the multiple charge transport layer is of the same thickness.

13. An imaging member in accordance with claim 1, wherein each of the layers of the multiple charge transport layer is of different thickness.

14. An imaging member in accordance with claim 1, wherein each of said charge transport layers contain N,N'-diphenyl-N,N'-bis(3-methylphenyl)-[1,1 '-biphenyl]-4,4'-diamine.

15. An imaging member in accordance with claim 1, wherein each of said charge transport layers contain N,N'-diphenyl-N,N'-bis(4-methylphenyl)-[1,1'-biphenyl]-4,4'-diamine.

16. An imaging member in accordance with claim 1, further comprising an adhesive layer and an overcoat layer.

17. An imaging member in accordance with claim 1, further comprising a substrate with a thickness of from about 50 micrometers to about 300 micrometers.

18. An imaging member in accordance with claim 1, wherein said substrate has a thickness of from about 80 to about 120 micrometers.

19. An imaging member in accordance with claim 1, further comprising a hole blocking layer, the hole blocking layer comprising a material selected from the group consisting of gamma amino propyl triethoxy silane, zinc oxide, titanium oxide, silica, polyvinyl butyral, and phenolic resins.

20. An imaging member in accordance with claim 19, wherein said hole blocking layer has a thickness of from 0.2 micrometers to about 2 micrometers.

21. An imaging member in accordance with claim 1, wherein said photogenerating layer comprises metal free phthalocyanines, metal phthalocyanines, vandyl phthalocyanines, perylenes, titanyl phthalocyanines, hydroxy gallium phthalocyanines, selenium, selenium alloys, or mixtures thereof.

22. The imaging member of claim 1, wherein the uppermost layer of the additional charge transport layers further comprises a nano particle dispersion wherein the particles are selected from the group consisting of silica, metal oxides, waxy polyethylene, and PTFE particles.

23. An imaging member in accordance with claim 1, wherein the concentration of charge transport component is reduced stepwise from the first charge transport layer to the uppermost layer of the additional charge transport layers.

24. An imaging member comprising:

an electrically conductive substrate or a substrate comprising an electrically conductive layer;

a photogenerating layer; and, a charge transport layer deposited on the photogenerating layer, wherein the charge transport layer comprises a first charge transport layer comprised of a charge transport component and a film forming polymer binder, and thereover and in contact with the first charge transport layer, about 2 to about 3 additional charge transport layers, each comprised of a charge transport component and a film forming polymer binder, wherein the amount of charge transport component in said layers of the charge transport layer is the greatest in said first charge transport layer and progressively decreases to the uppermost layer of the additional charge transport layers;

wherein the base layer of the additional charge transport layers contains from about 40 to about 60 weight percent of said charge transport component based on the total weight of the base layer; and wherein the charge transport layer further comprises a stabilizing hindered phenol, wherein the concentration of the hindered phenol increases from the first charge transport layer to the uppermost layer of the additional charge transport layers.

25. An imaging member in accordance with claim 24, wherein the charge transport layer has 3 additional charge transport layers, the second layer of the additional charge transport layers contains from about 30 to about 50 weight percent of said charge transport component, and the third layer of the additional charge transport layers contains from about 10 to about 30 weight percent by weight of said charge transport component and wherein said first charge transport layer contains from about 50 to about 90 weight percent of said charge transport component, wherein the weight percentage of the charge transport component is based on the total weight of the respective layer.

26. An imaging member comprising:

an electrically conductive substrate or a substrate comprising an electrically conductive layer;

a photogenerating layer; and, a charge transport layer deposited on the photogenerating layer, wherein the charge transport layer comprises a first charge transport layer comprised of a charge transport component and a film forming polymer binder, and thereover and in contact with the first charge transport layer, about 2 to about 3 additional charge transport layers, each comprised of a charge transport component and a film forming polymer binder, wherein the amount of charge transport component in said layers of the charge transport layer is the greatest in said first charge transport layer and progressively decreases to the uppermost layer of the additional charge transport layers;

wherein the base layer of the additional charge transport layers contains from about 30 to about 50 weight percent of said charge transport component based on the total weight of the base layer; and wherein the charge transport layer further comprises a stabilizing hindered phenol, wherein the concentration of the hindered phenol increases from the first charge transport layer to the uppermost layer of the additional charge transport layers.

27. An imaging member in accordance with claim 26, wherein the charge transport layer has 3 additional charge transport layers, the second layer of the additional charge transport layers contains from about 10 to about 35 weight percent of said charge transport component, and the third layer of the additional charge transport layers contains from about 5 to about 25 weight percent by weight of said charge transport component and wherein said first charge transport layer contains from about 40 to about 80 weight percent of said charge transport component, wherein the weight percentage of the charge transport component is based on the total weight of the respective layer.

28. An imaging member comprising:

an electrically conductive substrate or a substrate comprising an electrically conductive layer;

a photogenerating layer; and, a charge transport layer deposited on the photogenerating layer, wherein the charge transport layer comprises a first charge transport layer comprised of a charge transport component and a film forming polymer binder, and thereover and in contact with the first charge transport layer, a plurality of additional charge transport layers, each comprised of a charge transport component and a film forming polymer binder, wherein the amount of charge transport component in said layers of the charge transport layer is the greatest in said first charge transport layer and progressively decreases to the uppermost layer of the additional charge transport layers;

wherein each of the layers of the multiple charge transport layer is of a thickness of from about 5 to about 10 micrometers; and wherein the charge transport layer further comprises a stabilizing hindered phenol, wherein the concentration of the hindered phenol increases from the first charge transport layer to the uppermost layer of the additional charge transport layers.

29. An imaging member comprising:

an electrically conductive substrate or a substrate comprising an electrically conductive layer;

a photogenerating layer; and a charge transport layer, wherein the charge transport layer comprises:

a first charge transport layer deposited on the photogenerating layer comprised of a charge transport component molecularly dispersed in a film forming polymer resin binder, and thereover and in contact with the first charge transport layer;

a plurality of additional charge transport layers comprised of a charge transport component and a resin binder and wherein the amount of charge transport component in said layers is the greatest in said first charge transport layer and progressively decreases to the uppermost layer of the additional charge transport layers, and wherein the multiple charge transport layer further contains a hindered phenol in said additional charge transport layers, wherein the amount of said hindered phenol is the least in the layer of the additional charge transport layers in contact with said first charge transport layer and progressively increases to the uppermost layer of the additional charge transport layers.

30. An imaging member comprising:

an electrically conductive substrate or a substrate comprising an electrically conductive layer an optional hole blocking layer;

a photogenerating layer; and, a first charge transport layer in contact with said photogenerating layer and wherein said first charge transport layer is comprised of a charge transport component molecularly dispersed in a film forming polymer resin binder, and thereover and in contact with said first charge transport layer, a plurality of additional charge transport layers, each comprised of a charge transport component and a hindered phenol molecularly dispersed in a resin binder, and wherein the amount of charge transport component in said layers decreases in sequence from the first charge transport layer to the uppermost layer of the additional charge transport layers; and wherein the amount of hindered phenol increases in sequence from the first additional charge transport layer adjacent to the first charge transport layer to the uppermost layer of the additional charge transport layers.

* * * * *